US009289072B2

(12) United States Patent
Albero et al.

(10) Patent No.: US 9,289,072 B2
(45) Date of Patent: Mar. 22, 2016

(54) COMPRESSIBLE OR RETRACTABLE SUPPORT FOR AIR BLOWER CAVITY OF AIR FLOW MATTRESS

(71) Applicant: FXI, Inc., Media, PA (US)

(72) Inventors: Marc J. Albero, Glen Mills, PA (US); Christopher S. Weyl, Landenberg, PA (US)

(73) Assignee: FXI, Inc., Media, PA (US)

( * ) Notice: Subject to any disclaimer, the term of this patent is extended or adjusted under 35 U.S.C. 154(b) by 442 days.

(21) Appl. No.: 13/745,229

(22) Filed: Jan. 18, 2013

(65) Prior Publication Data

US 2014/0201919 A1 Jul. 24, 2014

(51) Int. Cl.

| | |
|---|---|
| ***A47C 27/08*** | (2006.01) |
| ***A61G 7/057*** | (2006.01) |
| ***A47C 21/04*** | (2006.01) |

(52) U.S. Cl.

CPC ..... *A47C 27/082* (2013.01); *A47C 21/044* (2013.01); *A61G 7/057* (2013.01); *A61G 7/05707* (2013.01); *A61G 7/05769* (2013.01)

(58) Field of Classification Search

CPC .... A47C 7/744; A47C 21/044; A47C 27/082; A47C 4/54; A47G 9/1027; A61G 7/05707; A61G 7/05769; A61G 7/057; B63B 7/08

USPC ..... 5/639, 644, 694, 706, 708, 709, 713, 5/726, 740, 652.2, 654, 655.3, 423

See application file for complete search history.

(56) References Cited

U.S. PATENT DOCUMENTS

| | | | | |
|---|---|---|---|---|
| 2,425,655 | A * | 8/1947 | Tompkins | 601/57 |
| 3,266,064 | A | 8/1966 | Figman | |
| 4,825,488 | A | 5/1989 | Bedford | |
| 5,068,933 | A * | 12/1991 | Sexton | 5/644 |
| 5,249,319 | A | 10/1993 | Higgs | |
| 5,325,551 | A | 7/1994 | Tappel et al. | |
| 5,606,756 | A | 3/1997 | Price | |
| 5,991,949 | A | 11/1999 | Miller, Sr. et al. | |
| 6,159,574 | A | 12/2000 | Landvik et al. | |
| 6,336,237 | B1 | 1/2002 | Schmid | |
| 6,541,094 | B1 | 4/2003 | Landvik et al. | |
| 6,591,437 | B1 | 7/2003 | Phillips | |
| 6,682,494 | B1 * | 1/2004 | Sleichter et al. | 601/57 |
| 6,684,434 | B2 | 2/2004 | Ellis et al. | |
| 6,887,173 | B2 * | 5/2005 | Lacroix et al. | 473/593 |

(Continued)

FOREIGN PATENT DOCUMENTS

WO 9820828 A1 5/1998

OTHER PUBLICATIONS

Int'l Search Report and Written Opinion issued Mar. 24, 2014 in Int'l Application No. PCT/US2013/075398.

*Primary Examiner* — Nicholas Polito

(74) *Attorney, Agent, or Firm* — Panitch Schwarze Belisario & Nadel LLP

(57) ABSTRACT

A compressible or retractable support is installed inside an air blower cavity of a body support system, such as a medical mattress with forced air flow. The support is compressed or retracted within the cavity when the air blower is inserted in the dynamic configuration of the body support system. The support rebounds to an uncompressed state to fill a greater portion of the air blower cavity when the air blower is removed to convert the body support system to a static configuration.

10 Claims, 6 Drawing Sheets

(56) References Cited

U.S. PATENT DOCUMENTS

| | | | | |
|---|---|---|---|---|
| 7,240,386 | B1 | 7/2007 | McKay et al. | |
| 7,255,917 | B2 | 8/2007 | Rochlin et al. | |
| 7,467,435 | B1 | 12/2008 | McKay et al. | |
| 7,469,437 | B2 | 12/2008 | Mikkelsen et al. | |
| 7,507,468 | B2 | 3/2009 | Landvik et al. | |
| 7,661,163 | B1 | 2/2010 | Gallaher | |
| 7,914,611 | B2 | 3/2011 | Vrzalik et al. | |
| 7,950,084 | B1 | 5/2011 | McKay et al. | |
| 8,025,964 | B2 | 9/2011 | Landvik et al. | |
| 8,034,445 | B2 | 10/2011 | Landvik et al. | |
| 8,104,125 | B2 | 1/2012 | Soltani et al. | |
| 2003/0037378 | A1* | 2/2003 | Wu | A47C 7/021 5/654 |
| 2003/0192127 | A1 | 10/2003 | Cook et al. | |
| 2004/0031103 | A1 | 2/2004 | Wyatt et al. | |
| 2004/0261183 | A1* | 12/2004 | Tsai | A47C 27/082 5/713 |
| 2005/0210595 | A1 | 9/2005 | Di Stasio et al. | |
| 2006/0053561 | A1* | 3/2006 | Metzger | A47C 27/082 5/713 |
| 2006/0101581 | A1 | 5/2006 | Blanchard et al. | |
| 2006/0213013 | A1* | 9/2006 | Wang | A47C 27/081 5/713 |
| 2006/0288491 | A1 | 12/2006 | Mikkelsen et al. | |
| 2007/0283500 | A1* | 12/2007 | Chang | 5/713 |
| 2009/0144903 | A1 | 6/2009 | Delvaux et al. | |
| 2009/0165213 | A1 | 7/2009 | Collins et al. | |
| 2009/0217458 | A1 | 9/2009 | Lord | |
| 2010/0071136 | A1* | 3/2010 | Weber | 5/655.9 |
| 2010/0170044 | A1 | 7/2010 | Kao et al. | |
| 2011/0047710 | A1 | 3/2011 | Beard | |
| 2011/0173758 | A1 | 7/2011 | Fontaine | |

* cited by examiner

COMPRESSIBLE OR RETRACTABLE SUPPORT FOR AIR BLOWER CAVITY OF AIR FLOW MATTRESS

BACKGROUND

1. Field of the Invention

The field of the present invention relates to body support systems that have a dynamic configuration with an air flow unit or air blower in an air blower cavity of the body support system, and a static configuration with the air flow unit or air blower removed from such air blower cavity, and a compressible or retractable support housed in the air blower cavity of said body support system.

2. Background

Those who care for persons confined to beds and wheelchairs understand the role body support systems play with respect to the prevention and treatment of pressure ulcers. Pressure ulcers, which are also known as bedsores, pressure sores, and decubitus ulcers, rapidly develop when prolonged pressure, heat, and moisture are applied to the skin. Persons at risk of developing pressure ulcers commonly are those who have a medical condition that renders them fully or partially immobile. Their inability to move, or to change positions more frequently when reclining or seated, causes an uncomfortable distribution of pressure applied against the skin that can directly lead to the development of pressure ulcers.

As uncomfortable distribution of pressure is applied against the skin, blood vessels become pinched, which in turn decreases blood supply at sites where pressure is applied. Heat, resulting from friction, rising body temperature, etc., also decreases blood supply at sites where the pressure is applied. And moisture from incontinence, perspiration, and exudate at these sites further exacerbates the skin, first causing bonds between epithelial layers to weaken, and thereafter causing skin maceration. Failure to address prolonged instances of pressure, heat, and moisture also can cause pressure ulcers to become sites that breed infection. These infection sites often lead to illness, and in severe cases—death.

Considering the severe consequences if pressure ulcers are not effectively treated, the ability of body support systems to relieve pressure from building up against the body and to affect heat and moisture levels at support surfaces is critical. Sufficient measures to prevent and treat pressure ulcers should, therefore, include the selection of body support systems that can redistribute pressure, withdraw heat, and draw away or evaporate moisture from support surfaces. Systems that redistribute pressure frequently are classified as either dynamic or static. Dynamic systems are driven, using an external source of energy (typically direct or alternating electrical current) to alter the level of pressure by controlling inflation and deflation of air cells within the system or the movement of air throughout the system. In contrast, static systems maintain a constant level of air pressure and redistribute pressure through use of materials that conform to body contours of the individual sitting or reclining thereon. Quantitative measurement of two parameters—Heat Withdrawal Capacity and Evaporative Capacity—also may be used to indicate a support surface's ability to withdraw heat and evaporate moisture.

Some medical mattresses are convertible from a static system to a dynamic system upon introducing an air blower or source of positive or negative pressure to the mattress. Some medical mattresses locate an air blower directly within a cavity or compartment inside the mattress. When a health professional or user wishes to convert a static system to a dynamic system with such convertible mattresses, frequently a separable pillow or support rig must first be removed from the cavity or compartment inside the mattress before the air blower may be inserted into such cavity. The separable pillow or support rig must be stored for future use, and often such separable pillows or support rigs are misplaced or discarded. When the health professional seeks to convert back to a static system, the air blower is removed leaving an empty cavity or compartment. If the separable pillow or support rig is misplaced or lost, the empty cavity alters the support characteristic of the body support surface above it. Hence, improvements continue to be sought.

SUMMARY

A body support system that is convertible from a dynamic configuration (including an air blower) to a static configuration (without the air blower) has at least one body supporting layer that defines at least one cavity adapted to house the air blower or air flow unit. The body support system may be a mattress, a pillow, a seat cushion, a mattress overlay, a mattress topper, or another cushioning device. The body support system has a dynamic configuration, wherein an air blower or air flow unit is activated to draw air and/or moisture vapor through portions of the body support system to, and a static configuration, wherein the body support system supports a sitting or reclining individual without an associated air blower or air flow unit.

A retractable support is adapted for removable insertion into the at least one cavity of the body support system. The retractable support has a resilient core having a first length when uncompressed and having a second length that is shorter than the first length when compressed or retracted. The resilient core is covered with an outer cover. When an air blower or air flow unit is inserted into the at least one cavity, the air blower or air flow unit is in contact with the retractable support that also is within such cavity. The air blower or air flow unit compresses the retractable support to its compressed or retracted position within the at least one cavity. When the air blower or air flow unit is extracted from the cavity, the retractable support rebounds from its compressed or retracted position to its original length, or close to its original length to fill or substantially fill that portion of the cavity evacuated by the air blower or air flow unit. Once rebounded to its original length or close to its original length, the retractable support provides cushioning support to that portion of the body supporting layer(s) above the at least one cavity.

The resilient core of the retractable support may comprise a polyurethane foam structure, and the polyurethane foam structure may have a center and comprises a plurality of outwardly extending arms from the center to form an X-shape or cross shape in cross-section. Alternatively, the polyurethane foam structure forming the resilient core of the retractable support may comprise cross sectional shapes of an oval, an ellipse, a circle or a zig-zag or accordion fold shape. The polyurethane foam forming the resilient core may be formulated to contain in situ one or more additives or may be coated with a coating that incorporates one or more additives. Suitable additives include: antimicrobial materials, antimicrobial compositions, fire retardant materials, fire retardant compositions, pigments, colorants and mixtures thereof The outer cover of the retractable support may comprise a vapor permeable material. Exemplary materials for the outer cover include fabrics, ticking fabrics, vinyl films, vapor permeable laminates that incorporate expanded polytetrafluoroethylene and nonwoven polypropylene fabrics.

A more complete understanding of various configurations of the body support systems and compressible, retractable supports disclosed herein will be afforded to those skilled in the art, as well as a realization of additional advantages and objects thereof, by consideration of the following detailed description. Reference will be made to the appended sheets which will first be described briefly.

BRIEF DESCRIPTION OF THE DRAWINGS

The drawings described herein are for illustrative purposes only and are not intended to limit the scope of the present disclosure. In the drawings, wherein like reference numerals refer to similar components.

DETAILED DESCRIPTION

As used herein the term "body support system" includes mattresses, pillows, seats, overlays, toppers, and other cushioning devices, used alone or in combination to support one or more body parts.

Turning in detail to the drawings, FIGS. 1-3A show construction of a compressible or retractable support 10 that includes a resilient core or spring structure 20 within an outer cover material 26. In this example, the resilient core or spring structure 20 of the retractable support 10 comprises an X-shape in cross-section with four arms extending outwardly from a center portion of the spring structure. The resilient core or spring structure 20 may be provided in alternative shapes, and is not limited to an X-shape in cross-section. Particularly desired are cross-sectional shapes in which a plurality of arms extend outwardly from a center portion of the spring structure. However, other retractable or compressible shapes may be employed provided that the resilient core or spring structure so configured has sufficient compressibility and sufficient resilience to rebound from compression to meet the objectives for retractable supports made thereof.

Figure 3A:
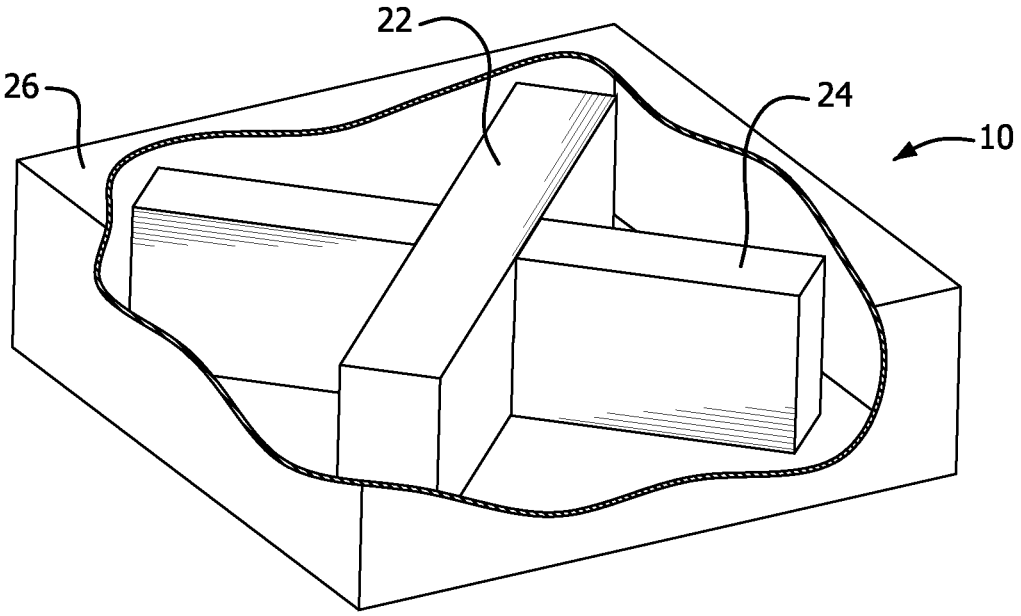
FIG. 3A is a right front perspective view of a compressible retractable support according to a first embodiment of the invention with a portion of its cover cut away.
Figure 3B:
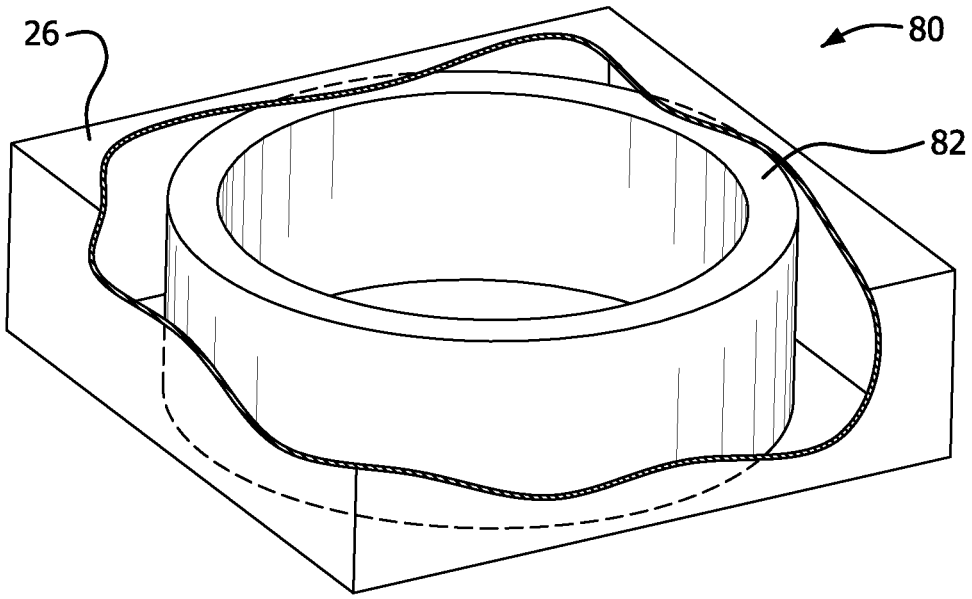
FIG. 3B is a right front perspective view of a compressible retractable support according to a second embodiment of the invention with a portion of its cover cut away.
Figure 3C:
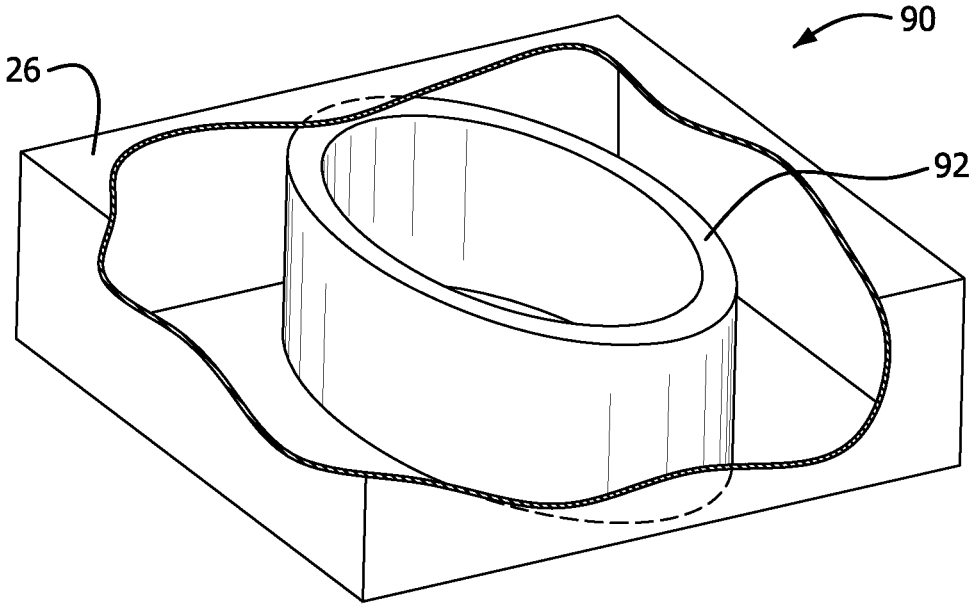
FIG. 3C is a right front perspective view of a compressible retractable support according to a third embodiment of the invention with a portion of its cover cut away.
Figure 3D:
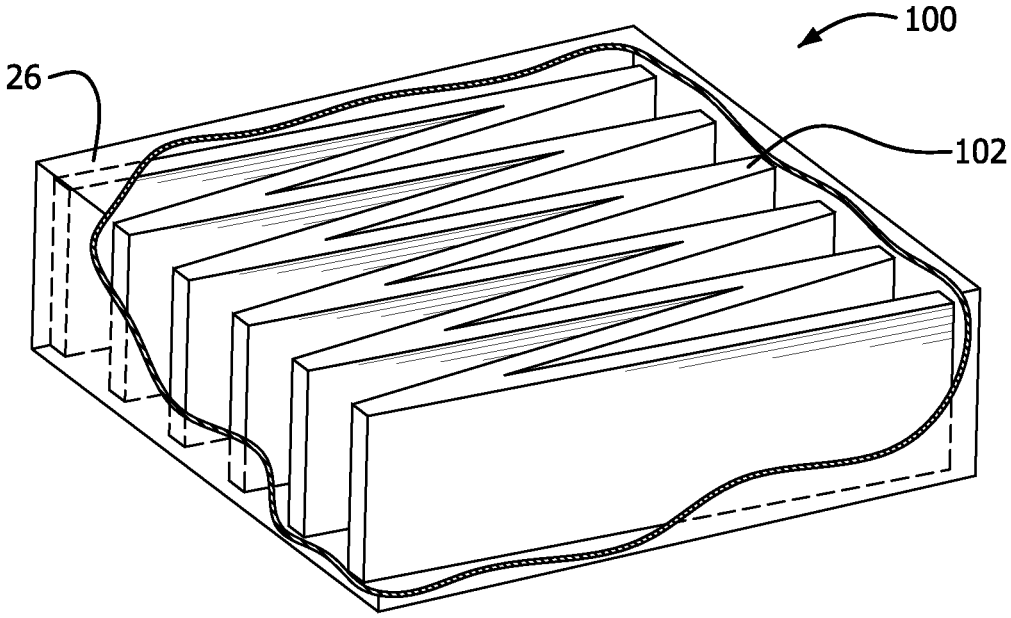
FIG. 3D is a right front perspective view of a compressible retractable support according to a fourth embodiment of the invention with a portion of its cover cut away.

FIGS. 3B-3D show alternative constructions of a compressible or retractable support 80, 90 and 100. Referring to FIG. 3B, the resilient core or spring structure 82 has a circular shape in cross section. Referring to FIG. 3C, the resilient core or spring structure 92 has an oval or elliptical shape in cross-section. Referring to FIG. 3D, the resilient core or spring structure 102 has an accordion-fold configuration or zig-zag configuration. In these embodiments, the resilient core or spring structure 82, 92, 102 maybe shaped of a cellular polymer material, such as polyurethane foam. The cellular polymer material may be molded into the desired configuration, or the desired configuration may be formed by shaping or cutting a block of cellular polymer material.

Figure 1:
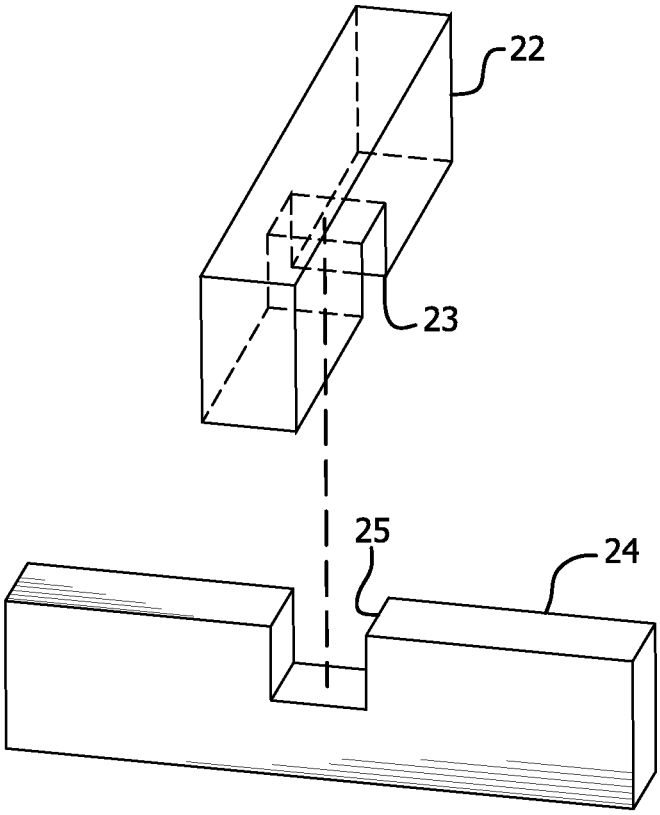
FIG. 1 is an exploded right front perspective view of an X-construction that forms the core of a compressible retractable support according to the invention.
Figure 2:
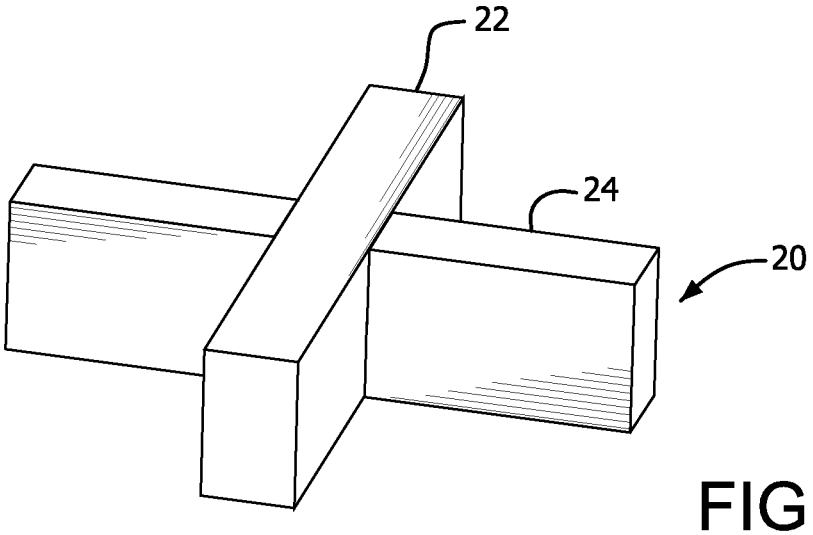
FIG. 2 is a right front perspective view of the X-construction of FIG. 2.

FIGS. 1 and 2 show one method for making a resilient core or spring structure 20 with an X-shape in cross-section. A first cross piece 22 defines a first recess, cavity or slot 23, and a second cross piece 24 defines a second recess, cavity or slot 25. The first and second slots 23, 25 in this example have comparable dimensions such that the first and second cross pieces 22, 24 may be joined together by seating the first and second slots 23, 25 together (compare FIGS. 1 and 2). Before joining together, an adhesive may be applied to surfaces within the first and/or second slots 23, 25. Upon curing the adhesive, the first and second cross pieces 22, 24 are held together in an X-shape cross-section configuration to form the resilient core or spring structure 20.

The resilient core or spring structure 20, 82, 92 and 102 may be formed of a cellular polymer, such as polyurethane foam, in particular, an open cell polyether polyurethane foam or an open cell polyester polyurethane foam with a density of 1.0 $lbf/ft^3$ to 3.0 $lbf/ft^3$, and an $IFD_{25}$ in the range of 10 lbf to 50 lbf. Indentation Force Deflection (hereinafter "IFD") is a measure of foam stiffness and is frequently reported in pounds of force (lbf). This parameter represents the force exerted when foam is compressed by 25% with a compression platen. One procedure for measuring IFD is set forth in ASTM D3574. According to this procedure, for $IFD_{25}$ at 25%, foam is compressed by 25% of its original height and the force is reported after one minute. Foam samples are cut to a size of 15"×15"×4" prior to testing.

The spring structure 20, 82, 92, 102 preferably is surrounded by a cover or sleeve 26 to form a retractable support 10, 80, 90, 100. The cover material may be any textile fabric or fabric laminate or polymeric film suitable for use in bedding systems. Examples of cover materials include protective laminates or fabrics that incorporate polyurethane coatings or membranes to create a liquid proof, wipable surface (i.e. fabrics, ticking fabrics, vinyl films, vapor permeable laminates that incorporate expanded polytetrafluoroethylene and nonwoven polypropylene fabrics). Preferably, after the spring structure 20, 82, 92, 102 is inserted within the cover or sleeve 26, the cover or sleeve 26 is sewn or adhered shut to preclude access to the spring structure held within. As constructed, the retractable support 10, 80, 90, 100 resembles a pillow.

The retractable support 10, 80, 90, 100 is intended for insertion into an air blower cavity 36 of a body support system 30. Referring now to FIGS. 4-7, a body support system 30 may be formed of one or a series of layers of support material. For example, the body support system 30 shown in FIGS. 4-7 comprises a mattress with an uppermost comfort layer 32 and at least one other support layer 34. The body support system 30 may be encased in a cover material, such as protective laminates or fabrics that incorporate polyurethane coatings or membranes to create a liquid proof, wipable surface (i.e. fabrics, ticking fabrics, vinyl films, vapor permeable laminates that incorporate expanded polytetrafluoroethylene and nonwoven polypropylene fabrics) (not shown in Figures).

When in use, the body support system 30 additionally may be covered by a textile bedding sheet or other customary textile bedding (not shown).

The uppermost comfort layer(s) 32 may be formed of a cellular polymer, such as an open cell polyurethane foam. The uppermost comfort layer(s) 32 optionally are manufactured from materials having a temperature and pressure sensitive cellular polymer structure. Such structures include viscoelastic open cell polyurethane foams that optionally are reticulated. Viscoelastic open cell polyurethane foams have the ability conform to body contours when subjected to compression from an applied load and then slowly return to their original uncompressed state, or close to their uncompressed state, after removal of the applied load. One definition of viscoelastic foam is derived by a dynamic mechanical analysis that measures the glass transition temperature (Tg) of the foam. Nonviscoelastic resilient polyurethane foams, based on a 3000 molecular weight polyether triol, generally have glass transition temperatures below −30° C., and possibly even below −50° C. By contrast, viscoelastic polyurethane foams have glass transition temperatures above −20° C. If the foam has a glass transition temperature above 0° C., or closer to room temperature (e.g., room temperature (20° C.)), the foam will manifest more viscoelastic character (i.e., slower recovery from compression) if other parameters are held constant.

In addition, in some configurations, at least a portion of an uppermost comfort layer is reticulated. Reticulated polyurethane foam materials include those materials manufactured using methods that remove or break cell windows. Various mechanical, chemical and thermal methods for reticulating foams are known. For example, in a thermal method, foam may be reticulated by melting or rupturing the windows with a high temperature flame front or explosion, which still leaves the strand network intact. Alternatively, in a chemical method the cell windows may be etched away using the hydrolyzing action of water in the presence of an alkali metal hydroxide. If a polyester polyurethane foam has been made, such foam may be chemically reticulated to remove cell windows by immersing a foam slab in a heated caustic bath for from three to fifteen minutes. One possible caustic bath is a sodium hydroxide solution (from 5.0 to 10.0 percent, preferably 7.5% NaOH) that is heated to from 70° F. to 160° F. (21° C. to 71° C.), preferably from 120° F. to 160° F. (49° C. to 71° C.). The caustic solution etches away at least a portion of the cell windows within the foam cellular structure, leaving behind hydrophilic ester polyurethane foam.

Materials used for the uppermost comfort layer(s) 32 may be classified as low air loss materials. Materials of this type are capable of providing air flow to a support surface for management of heat and humidity at one or more microclimate sites. In preferred embodiments, the comfort layer(s) are formed of reticulated polyurethane foam(s) having a porosity ranging from about 65 pores per inch to about 75 pores per inch and air permeability values ranging from about 150 cubic feet per square foot per minute ($ft^3/ft^2/min$) to 350 $ft^3/ft^2/min$.

In the example shown in FIGS. 4-7, the uppermost comfort layer 32 defines a cavity 36 for housing an air blower or air flow unit 40 when the body support system is used in a dynamic configuration. The cavity 36 may be lined with a fabric or laminate or the same type of material forming the cover material for the retractable support. If so lined, an opening 46 is formed in the lining material of the cavity 36 to facilitate air flow communication between the air blower 40 and the uppermost comfort layer(s) and/or air flow channel(s) defined within the uppermost comfort layer(s). The uppermost comfort layer(s) 32 further define an air intake 38 spaced a distance from the cavity 36. In this way, air may flow through the uppermost comfort layer(s) and/or air flow channel(s) defined within the uppermost comfort layer(s) between the air intake 38 and the air blower 40. While only one air intake 38 is shown in the uppermost comfort layer 32 in this example, additional air intakes as desired may be provided in the uppermost comfort layer(s) or in other layers forming the body support system.

The air blower 40 has a portal 44 through which air flows at the interface between the uppermost comfort layer 32 and the air blower 40 when the air blower 40 is installed in the cavity 36.

One or more air blowers or air flow units 40 may be disposed within the body support system 30 to facilitate air flow along one or more air flow paths, depending upon the positioning of air inlets and air outlets within the system 30. Both air inlets and air outlets may be defined in one or more cavities positioned within the system. Air flow units 40 may be configured to generate air flow using either positive or negative pressure. Suitable air flow units include a 12V DC Blower provided by Delta Electronics. The use of air flow units 40 facilitates withdrawal from and removal of moisture and heat at foam support surfaces 32.

An air flow unit 40 may include a screen coupled to a filter (not shown), which in combination are used to filter particles, spores, bacteria, etc., which would otherwise exit the body support system 30 into the room air through air flow unit 40. During operation, the air flow unit 40 may operate to reduce and/or increase pressure within the system to facilitate air flow along air flow paths from an air intake or air inlet 38 to an air outlet at the air blower 40. Regardless of the placement of an air blower or air flow unit 40 within the system, it should be configured to exhaust air to the surrounding environment.

Figure 4:
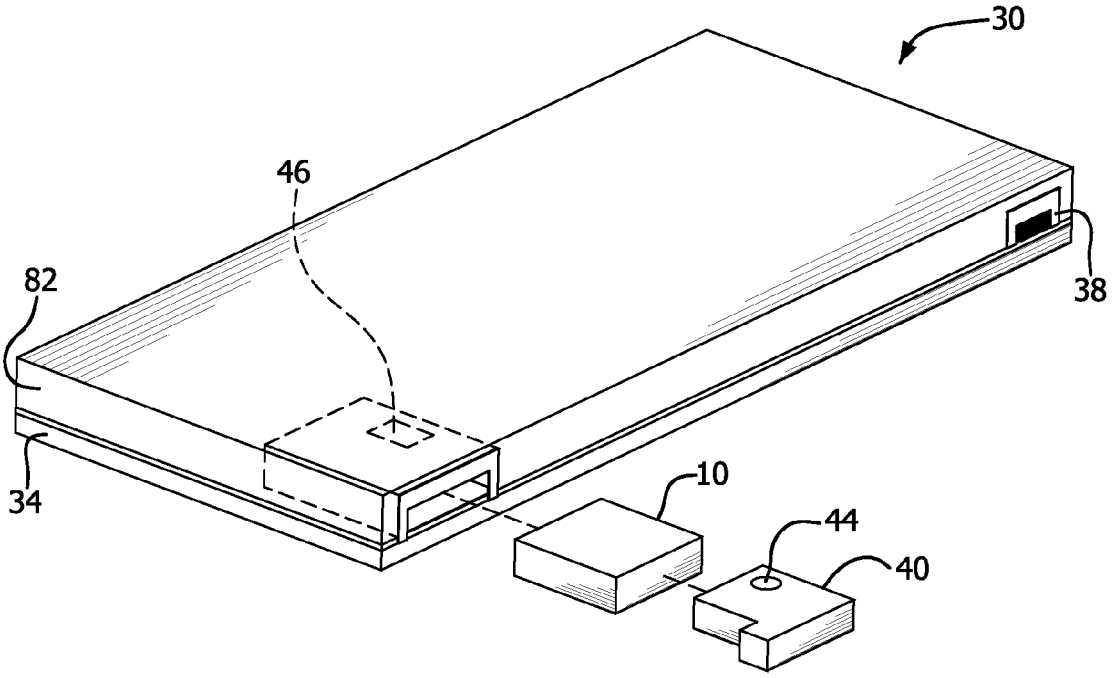
FIG. 4 is an exploded right front perspective view of a body support system or mattress, a compressible retractable support and an air blower.
Figure 5:
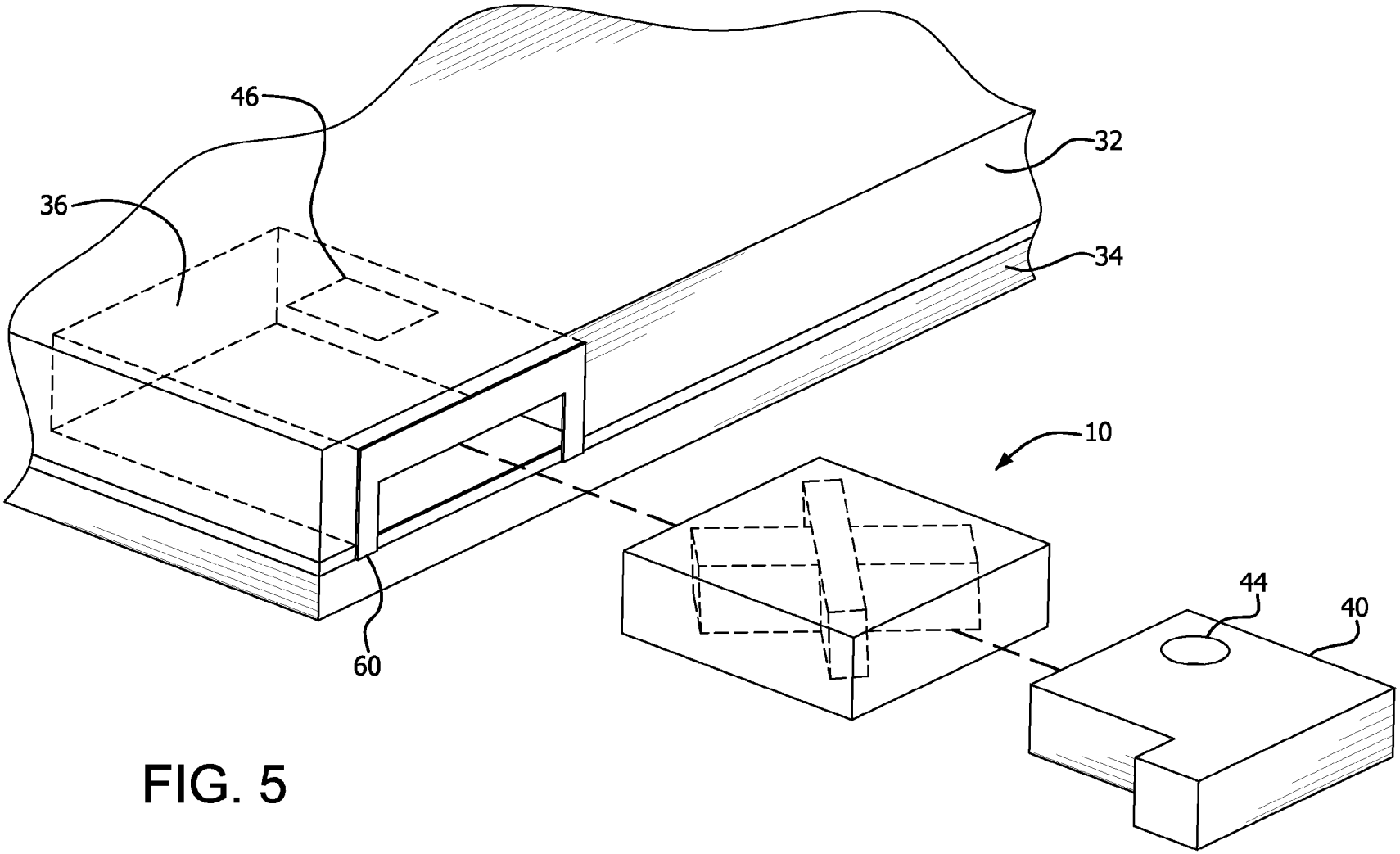
FIG. 5 is an exploded partial right front perspective view of the body support system or mattress, the compressible retractable support and the air blower of FIG. 4.
Figure 7:
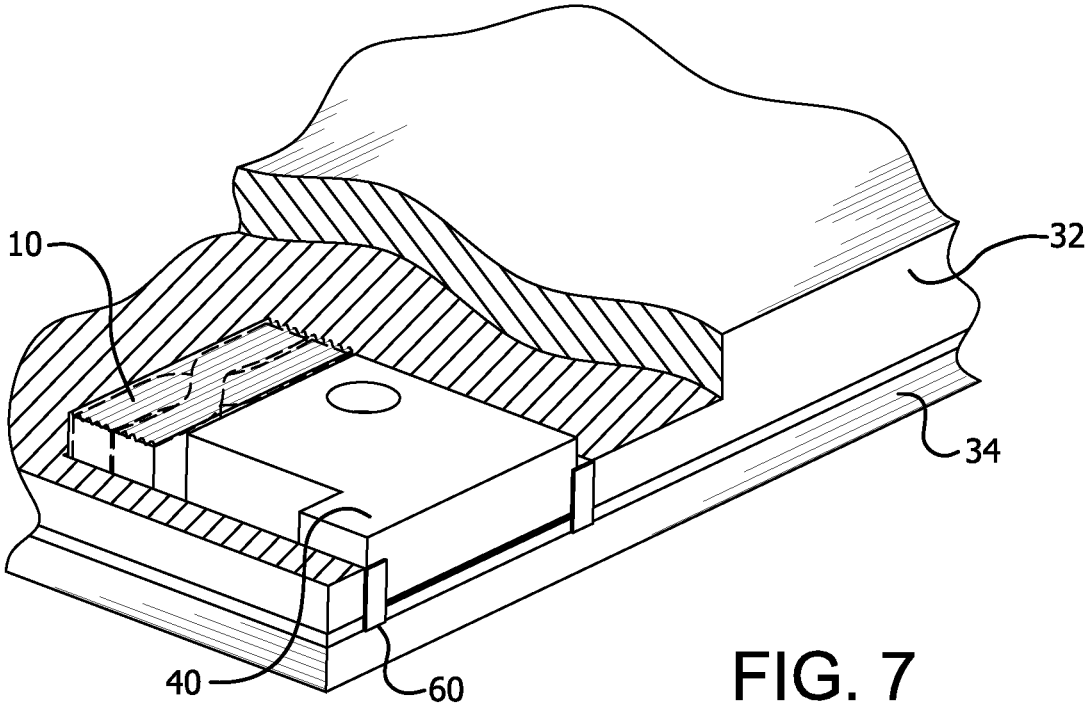
FIG. 7 is a partial right front perspective view of the body support system in a dynamic configuration with the compressible retractable support in its compressed state and both the compressible retractable support and the air blower located inside the cavity of the body support system.

Referring particularly to FIGS. 4 and 5, the retractable support 10 is inserted first into the air blower cavity 36. The air blower or air flow unit 40 next is inserted into the air blower cavity 36 if the body support system 30 (e.g., mattress) is to be used in a dynamic configuration. The air blower or air flow unit 40 is urged into the cavity 36 to a sufficient degree so that the blower portal 44 of the air flow unit 40 is positioned near air intake 38 defined in the cavity 36 or cavity lining. By so positioning the air blower or air flow unit 40, the retractable support 10 is compressed or collapsed to a smaller length such that it fits in a smaller volume of the air blower cavity 36 at the rearmost portion of the cavity 36 as shown in FIG. 7. The resilient core or spring structure 20 compresses or collapses, and the cover material folds or creases as shown in FIG. 7.

The air blower or air flow unit 40 may be maintained within the air blower cavity 36 by action of outer drape or rim 60 about the periphery of the open side of the air blower cavity 36.

Figure 6:
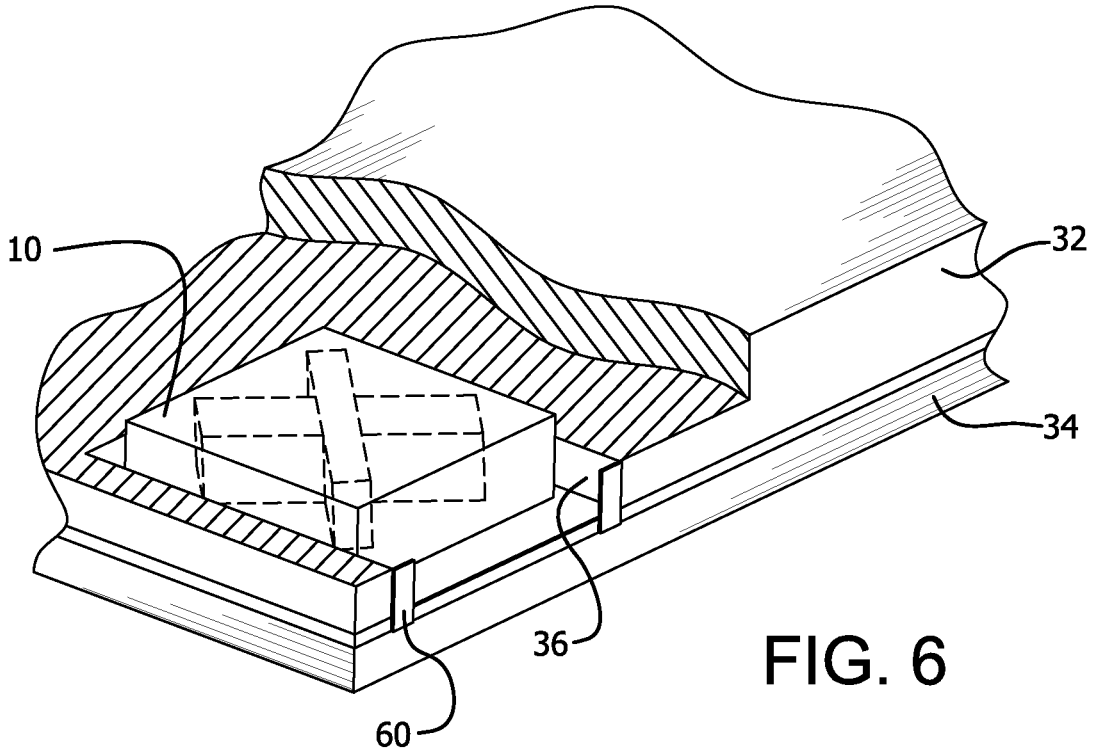
FIG. 6 is a partial right front perspective view of the body support system in a static configuration with the compressible retractable support in an uncompressed state inside a cavity of the body support system.

If the body support system 30 then is converted from a dynamic configuration (FIG. 7) to a static configuration by removing the air blower or air flow unit 40 from the air blower cavity 36, the retractable support 10 rebounds to an uncompressed and uncollapsed state as shown in FIG. 6. Preferably, the retractable support 10 recovers or rebounds to its original uncompressed lengthwise dimension, or to substantially its original uncompressed lengthwise dimension. In this way, the retractable support 10 fills or substantially fills the air blower cavity 36 and provides cushioning support within the body support system 30 in the absence of the air blower or air flow unit 40. Because the resilient core or spring structure of the retractable support 10 has spring-like resilience, the retractable support 10 may be compressed and permitted to rebound a number of cycles and still fulfill its supportive cushioning role in its uncompressed state. The retractable support 10 may continue to be held within the air blower cavity 36 whether the body support system 30 is used in a dynamic configuration (with an air blower) or in a static configuration (without an air blower). Optionally, and preferably, the retractable support 10 may be removed from the air blower cavity 36 for cleaning or as desired.

One or more of the elements included within the body support system 30 and the retractable support 10 disclosed herein may incorporate antimicrobial devices, agents, etc. Because air can carry bacteria, viruses, and other potentially harmful pathogens, the system and support may be provided with devices and agents that prevent, destroy, mitigate, repel, trap, and/or contain potentially harmful pathogenic organisms. In addition to bacteria and viruses, such organisms include, but are not limited to, mold, mildew, dust mites, fungi, microbial spores, bioslimes, protozoa, protozoan cysts, and the like. Preferred antimicrobial devices and agents include ULTRA-FRESH from Thomson Research Associates, Toronto, Canada.

Thus, various configurations of body support systems with compressible or retractable supports are disclosed. While embodiments of this invention have been shown and described, it will be apparent to those skilled in the art that many more modifications are possible without departing from the inventive concepts herein. Moreover, the examples described herein are not to be construed as limiting. The invention, therefore, is not to be restricted except in the spirit of the following claims.

What is claimed is:

1. A body support system convertible from a dynamic configuration to a static configuration, comprising:

at least one body supporting layer, said layer having a body supporting surface, side walls and end walls and said layer defining at least one cavity therein with a depth into the body supporting layer and a cavity height, said at least one cavity disposed below the body supporting surface of the body supporting layer and having a cavity opening through an end wall or a side wall, said cavity adapted to house an air flow unit or air blower;

a retractable support with a resilient core having a first length when uncompressed, wherein the first length is the same or substantially the same as the depth of the at least one cavity, and having a second length that is shorter than the first length when compressed or retracted, and with an outer cover surrounding the resilient core, said retractable support adapted for removable insertion into the at least one cavity; and an air flow unit or air blower adapted for removable insertion into the at least one cavity, with said air flow unit or air blower in contact with the retractable support when so inserted to compress the retractable support to its compressed or retracted position corresponding to its second length when the air blower and retractable support are both held within the at least one cavity, wherein said retractable support rebounds from its second length to its first length when the air flow unit or air blower is removed from the at least one cavity.

2. The body support system of claim 1, wherein the resilient core of the retractable support comprises a polyurethane foam structure.

3. The body support system of claim 2, wherein the polyurethane foam structure defines a center and comprises a plurality of outwardly extending arms from the center of the polyurethane foam structure.

4. The body support system of claim 3, wherein the polyurethane foam structure has four outwardly extending arms and comprises an X-shape in cross-section.

5. The body support system of claim 2, wherein the polyurethane foam structure has a shape selected from the group consisting of: cross, oval, ellipse, circle and zig-zag.

6. The body support system of claim 1, wherein the outer cover of the retractable support comprises a vapor permeable material.

7. The body support system of claim 1, wherein the outer cover of the retractable support is formed of a material selected from the group consisting of: fabrics, ticking fabrics, vinyl films, vapor permeable laminates that incorporate expanded polytetrafluoro-ethylene and nonwoven polypropylene fabrics.

8. The body support system of claim 1, wherein the resilient core is formed of a polyurethane foam that has been formulated to contain in situ one or more additives or has been coated with a coating that incorporates one or more additives, wherein said one or more additives are selected from the group consisting of: antimicrobial materials, antimicrobial compositions, fire retardant materials, fire retardant compositions, pigments, colorants and mixtures thereof.

9. The body support system of claim 1, wherein the body support system comprises a mattress, a pillow, a seat cushion, a mattress overlay, a mattress topper, or another cushioning device.

10. The body support system of claim 1, wherein the at least one cavity opens to an end wall or a side wall edge of the at least one body supporting layer, and a rim is installed at least partially around the edge to maintain the retractable support and the air blower within the at least one cavity.

* * * * *